US007088034B2

(12) United States Patent
Shimaoogi et al.

(10) Patent No.: US 7,088,034 B2
(45) Date of Patent: Aug. 8, 2006

(54) CATHODE-RAY TUBE EMPLOYING A SEPARATE GRID STRUCTURE TO STABILIZE CATHODE CURRENT

(75) Inventors: Toshio Shimaoogi, Ibaraki (JP); Shigeru Sugawara, Ibaraki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/887,814

(22) Filed: Jul. 12, 2004

(65) Prior Publication Data

US 2005/0012443 A1 Jan. 20, 2005

(30) Foreign Application Priority Data

Jul. 16, 2003 (JP) ..... 2003-197793

(51) Int. Cl.
*H01J 29/04* (2006.01)

(52) U.S. Cl. ..... 313/446; 313/412; 313/417; 313/456

(58) Field of Classification Search ..... 313/447, 313/446, 452, 414, 412, 417, 456
See application file for complete search history.

(56) References Cited

U.S. PATENT DOCUMENTS 5,637,952 A * 6/1997 Tischer ..... 313/412

FOREIGN PATENT DOCUMENTS

JP 2002-110056 4/2002
JP 2002-184320 6/2002

OTHER PUBLICATIONS

T. Shiroishi, et al. "Development of Electron Gun for High Brightness CRT"; IDW '02; Dec. 4, 2002; p. 611.

* cited by examiner

*Primary Examiner*—Ashok Patel
(74) *Attorney, Agent, or Firm*—Oblon, Spivak, McClelland, Maier & Neustadt, P.C.

(57) ABSTRACT

An electron gun assembly that emits three electron beams, which are arranged in line, toward a phosphor screen includes three cathodes arranged in line, three first grids arranged to face the associated cathodes, and a second grid with an integral structure that is disposed to face a phosphor screen side of the first grids. Each of the first grids is formed of a cup-shaped electrode body having an electron beam passage hole. The electron gun assembly further includes an insulation member through which the three first grids penetrate, the insulation member thus integrally holding the three first grids, a cylindrical member that surrounds the insulation member and has an implant part, and an insulating support member that supports the implant part of the cylindrical member.

4 Claims, 7 Drawing Sheets

CATHODE-RAY TUBE EMPLOYING A SEPARATE GRID STRUCTURE TO STABILIZE CATHODE CURRENT

CROSS-REFERENCE TO RELATED APPLICATIONS

This application is based upon and claims the benefit of priority from prior Japanese Patent Application No. 2003-197793, filed Jul. 16, 2003, the entire contents of which are incorporated herein by reference.

BACKGROUND OF THE INVENTION

1. Field of the Invention

The present invention relates generally to a cathode-ray tube, and more particularly to a color cathode-ray tube including a grid structure that can stabilize, in a short time from the start of operation, a cathode current value of an in-line electron gun assembly that is mounted in the cathode-ray tube.

2. Description of the Related Art

In a color cathode-ray tube, which is currently used in general, an in-line electron gun assembly that emits three electron beams for blue, green and red, which are horizontally arranged in line, is provided within the neck of the envelope. Electron beams that are emitted from the electron gun assembly are deflected by polarizing magnetic fields that are generated by a deflection yoke. Thereby, the electron beams are caused to scan the phosphor screen in the horizontal and vertical directions. Thus, a color image is reproduced on the phosphor screen.

The above-described in-line electron gun assembly greatly contributes to enhancement in quality and performance of the color cathode-ray tube, and it is widely employed in modern cathode-ray tubes. The electron gun assembly includes three cathodes, which are horizontally arranged in line, three heaters, which are inserted in the respective cathodes, and a plurality of grids, which are coaxially arranged at predetermined intervals from the cathode side toward the phosphor screen.

As is shown in FIG. 7 and FIG. 8, for example, an electron beam generating section that generates electron beams toward the phosphor screen includes cylindrical cathodes K (KB, KG, KR), cup-shaped first grids G1 that control the electron beams emitted from the cathodes K, and a plate-shaped second grid G2 that accelerates the electron beams. The cathodes K, first grid G1 and second grid G2 are coaxially arranged at predetermined intervals and are fixed by an insulation glass 66. Three cathode support members 63 hold the associated cathodes K. An insulation member 64 integrally holds the cathode support members 63. A metal cylinder 65 surrounds the outer periphery of the insulation member 64.

In the color cathode-ray tube using the above-described in-line electron gun assembly 57, in order to obtain a good white screen, cutoff voltages in the electron beam generating section that generates the respective three electron beams, are designed to become equal. In other words, each of cathode current values (IK values) of the respective cathodes K is designed to be set at a predetermined fixed value.

In general, the respective cutoff voltages in the electron gun assembly 57 do not become equal due to non-uniformity in components or a difference in thermal expansion coefficient. In order to set the IK value of each cathode K at a predetermined fixed value, bias voltages are adjusted in accordance with the characteristics of the respective cathodes K after the color cathode-ray tube is assembled in a cathode-ray tube apparatus such as a TV receiver. Thereby, equality between IK values is ensured.

Even if such a measure is taken to secure equality between IK values, the IK values of the cathodes cannot be set at a predetermined fixed value during a warming-up time beginning with turn-on of the heaters and continuing until thermal deformation of each component reaches an equilibrium state. In other words, even if the bias voltages are adjusted to secure the equality between IK values, the equality between IK values is actually obtained after the end of the warming-up time. The time needed for the warming-up is about 20 minutes after power-on.

To be more specific, when the heaters are turned on and the respective components reach the thermal equilibrium state, the cathodes K operate in a higher temperature range than the cathode support members 63, and the cathode support members 63 operate in a higher temperature range than the insulation member 64. In other words, the rate of temperature rise is higher in the cathode support members 63 than in the insulation member 64 that supports the cathode support members 63, and the rate of temperature rise is higher in the cathodes K than in the cathode support members 63.

As a result, the respective electrode components of the electron gun assembly 57 have different thermal deformation characteristics because of thermal expansion due to different rates of temperature rise. The thermal deformation is explained referring to FIG. 9 and FIG. 10. In FIG. 9, arrows indicate directions of extension of associated structural components. In FIG. 10, characteristic curves A, B and C correspond to arrows A, B and C in FIG. 9.

As is indicated by arrow A in FIG. 9, the cathode K extends toward the first grid G1 due to temperature rise during the warming-up time. The shape of the cathode K varies with time, as indicated by characteristic curve A in FIG. 10. By contrast, as is indicated by arrow B in FIG. 9, the cathode support member 63 extends in a direction away from the first grid G1, that is, toward the stem side, due to temperature rise during the warming-up time. The shape of the cathode support member 63 varies with time, as indicated by characteristic curve B in FIG. 10. In addition, as indicated by arrow C in FIG. 9, the first grid G1 extends in a direction away from the cathode K due to temperature rise, and the shape thereof varies as indicated by characteristic curve C in FIG. 10.

The cathode K and cathode support member 63 are disposed close to the heater and are formed using thin plates. Thus, the cathode K reaches a thermal equilibrium state within about 30 seconds from power-on, and the cathode support member 63 reaches a thermal equilibrium state in a relatively short time period of about three minutes.

By contrast, the first grid G1 reaches a thermal equilibrium state about 15 minutes after power-on. Thus, after the passage of about three minutes from the beginning of the warming-up time period, the distance between the cathode K and first grid G1 varies mainly due to thermal deformation of the first grid G1.

Consequently, in the warming-up time period, the distance between the cathode K and first grid G1 varies, as shown by curve D in FIG. 10, due to the above-mentioned thermal expansion of the respective components. Since the distance between the cathode K and first grid G1 varies in the warming-up time period, about 15 minutes from power-on of the heater are needed until the respective components reach an equilibrium state of operational temperatures.

In addition, after the end of warming-up, in order to keep equal the IK values of the three cathodes K, bias voltages are adjusted so as to correct a non-uniform distance between the electrodes, in particular, between the cathode K and first grid G1. However, after the color cathode-ray tube is assembled in the cathode-ray tube apparatus, the once set bias voltages cannot be adjusted unless the cathode-ray tube apparatus is opened. It is difficult for the user to perform such adjustment. Disadvantageously, the once set equality between IK values cannot actually be achieved until the operation temperature reaches the thermal equilibrium state.

FIG. 11 shows examples of IK value curves that indicate variations with time from power-on until each IK value reaches a predetermined fixed value. In these examples, bias voltages are adjusted such that the cathode current values of the center beam cathode KG, which is disposed substantially at the center of the neck, and the side beam cathodes KR and KB, which are disposed on both sides of the cathode KG, may become 10 μA after the end of warming-up. Thereafter, sufficiently cooling is conducted in the state in which the heater voltage alone is turned off. Then, the heater is powered on. FIG. 11 shows resultant variations with time of cathode current values. In FIG. 11, curve I indicates IK value characteristics of the center beam cathode KG of the three in-line cathodes K. Curve II indicates IK value characteristics of the side beam cathode KB (or KR).

The IK value characteristics of the curves I and II are different because the first grid G1G for the center beam and the first grids G1B and G1R for the side beams are differently affected by the temperatures and thermal expansion of the electrode components that are disposed on the periphery of each first grid G1.

In FIG. 11, as regards both curves I and II, a variation in IK value within about 30 seconds after power-on of the heater is mainly due to the fact that the cathode K extends toward the first grid G1. In addition, a variation in IK value in a time period between about 30 seconds and about three minutes after power-on of the heater is mainly due to the fact that the cathode support member 63 extends in a direction away from the first grid G1. A variation in IK value after the passage of about three minutes from power-on of the heater is mainly due to the thermal deformation of the first grid G1.

In particular, as regards the in-line electron gun assembly 57 including the individual first grids G1 (G1B, G1G, G1R), as shown in FIG. 12, implant parts for fixing the three first grids G1B, G1G and G1R to the insulation glass 66 need to be configured such that the three first grids G1 (G1B, G1G, G1R) are accommodated within the limited inside diameter of the neck and are completely supported and held within the width of the insulation glass 66 in the in-line direction. To meet this requirement, an implant member 68 for the first grid G1G (center beam) and implant members 69 for the first grids G1B and G1R (both side beams) need to have different shapes.

Specifically, the implant member 68 for first grid G1G (center beam) is formed to be axisymmetric with respect to both an in-line directional axis 70 of beam passage holes and a vertical axis 71 that intersects at right angles with the in-line directional axis 70 and passes through the center beam passage hole. By contrast, each of the implant members 69 for first grids G1B and G1R (both side beams) is formed to be axisymmetric with respect to the in-line directional axis 70 and to be non-axisymmetric with respect to a vertical axis 72 that intersects at right angles with the in-line directional axis 70 and passes through the associated side beam passage hole.

Thereby, the first grid G1G and the two first grids G1B and G1R can have substantially equal temperatures when they reach the thermally stable state. However, the first grid G1G and two first grids G1B and G1R require different times until they reach the thermally stable state. To be more specific, the first grid G1G has both sides and vertical ends surrounded by the other electrodes and insulation glass. On the other hand, only the first grid G1G is disposed around each of the first grid G1B and G1R. Consequently, the first grid G1G requires a longer time than each of the first grids G1B and G1R before reaching the thermally stable state.

As stated above, the first grid G1G and each of the first grids G1B and G1R reach the set IK value in different modes. Hence, a time period that is approximately equal to the warming-up time is needed until the equality of IK values of the three cathodes K is attained and a good white screen is obtained.

Consequently, a considerable length of time is required until a good white screen is obtained after power-on of the color cathode-ray tube. Moreover, it is difficult for a general user to adjust bias voltages after the color cathode-ray tube is assembled in the cathode-ray tube apparatus. Thus, the equality between IK values that are once set cannot actually be obtained until the respective components reach the equilibrium state of operational temperatures. A long time is needed in order to obtain a good white screen. This means that a low-quality image is displayed for a long time after power-on of the cathode-ray tube apparatus.

To solve the above-problem, there is prior art (e.g. Jpn. Pat. Appln. KOKAI Publication No. 2002-184320) wherein the relationship between the length to a fixing point between a cathode support member for a center beam and a metal cylinder disposed around this cathode support member, on the one hand, and the length to a fixing point between a cathode support member for a side beam and a metal cylinder disposed around this cathode support member, on the other hand, is defined with reference to a fixing point between each cathode and the associated cathode support member. Further, there is prior art (e.g. Jpn. Pat. Appln. KOKAI Publication No. 2002-110056) wherein the relationship between the length from the fixing point between a center beam cathode and an associated cathode support member to an insulation member, on the one hand, and the length from the fixing point between a side beam cathode and an associated support member to the insulation member, on the other hand, is defined.

BRIEF SUMMARY OF THE INVENTION

The present invention has been made in consideration of the above-described problems, and its object is to provide a cathode-ray tube that is capable of displaying a high-quality image within a short time period from power-on.

According to a first aspect of the present invention, there is provided a cathode-ray tube comprising an electron gun assembly that emits three electron beams, which are arranged in line, toward a phosphor screen, wherein the electron gun assembly comprises three cathodes arranged in line, three first grids arranged to face the associated cathodes, and a second grid with an integral structure that is disposed to face a phosphor screen side of the first grids, each of the first grids is a cup-shaped electrode body having an electron beam passage hole, and the electron gun assembly comprises: an insulation member through which the three first grids penetrate, the insulation member thus integrally holding the three first grids; a cylindrical member that surrounds the insulation member and has an implant part;

and an insulating support member that supports the implant part of the cylindrical member.

According to a second aspect of the present invention, there is provided a cathode-ray tube comprising an electron gun assembly that emits three electron beams, which are arranged in line, toward a phosphor screen, wherein the electron gun assembly comprises three cathodes arranged in line, three first grids arranged to face the associated cathodes, and a second grid with an integral structure that is disposed to face a phosphor screen side of the first grids, each of the first grids comprises a grid disc having an electron beam passage hole, and a cup-shaped grid support member that supports the grid disc, and the electron gun assembly comprises: an insulation member through which the three grid support members penetrate, the insulation member thus integrally holding the three grid support members; a cylindrical member that surrounds the insulation member and has an implant part; and an insulating support member that supports the implant part of the cylindrical member.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Cathode-ray tubes according to embodiments of the present invention will now be described with reference to the accompanying drawings.

Figure 1:
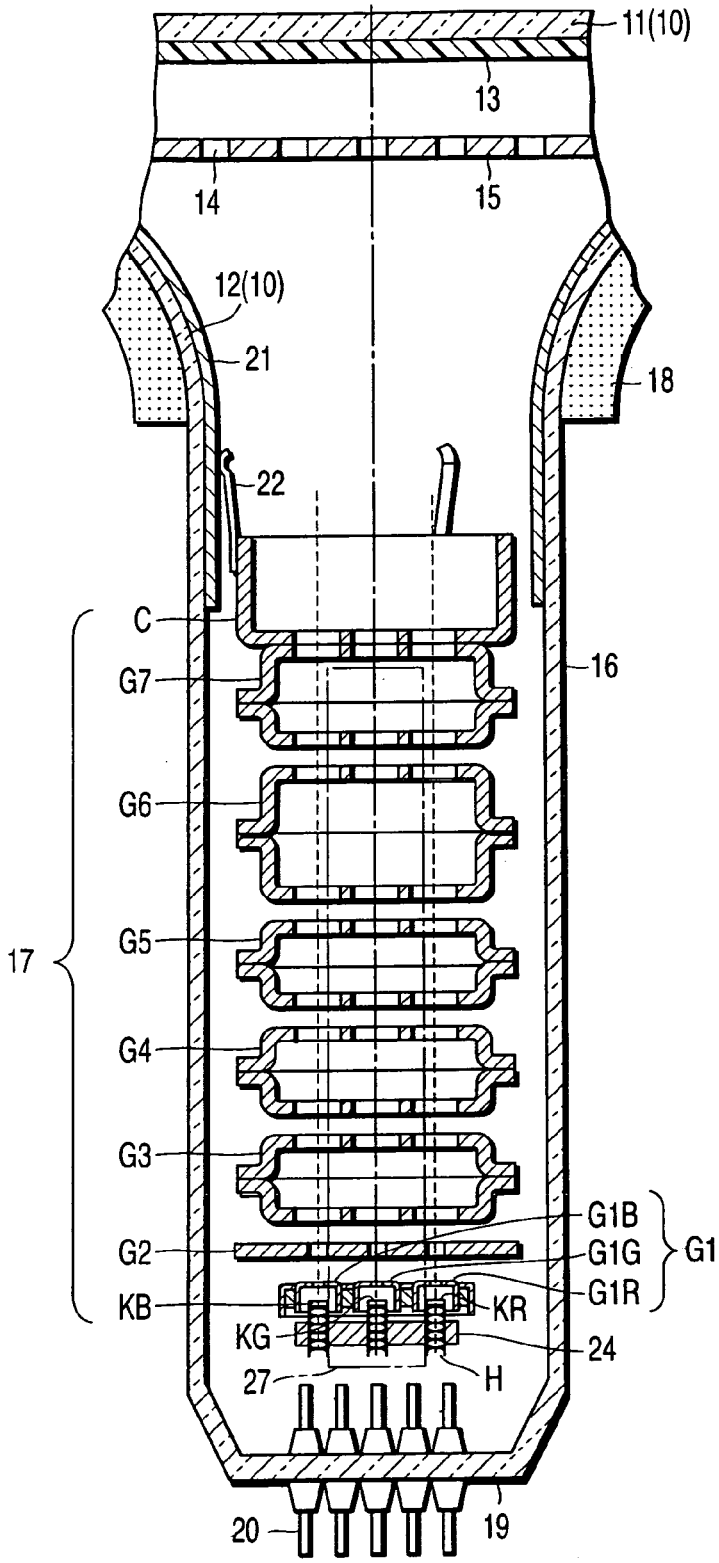
FIG. 1 is a horizontal cross-sectional view that schematically shows the structure of a cathode-ray tube according to a first embodiment of the present invention.

As is shown in FIG. 1, a color cathode-ray tube includes an envelope 10. The envelope 10 includes a face panel 11 with a substantially rectangular screen shape, and a funnel 12 that is integrally coupled to the face panel 11. A phosphor screen 13 is disposed on the inside of the face panel 11 and has three-color phosphor layers that emit red, blue and green light.

A shadow mask 15 with a number of apertures 14 is disposed to face the phosphor screen 13 in the envelope. Electron beams pass through the apertures 14, thereby making color selection. The shadow mask 15 is attached to the inside of the face panel 11 via a mask frame (not shown).

An in-line electron gun assembly 17 is disposed within the neck 16 of the funnel 12. The electron gun assembly 17 emits three electron beams, which are arranged in line in an in-line direction, i.e. in the horizontal direction, toward the phosphor screen 13. Of the three electron beams, the center beam, which is emitted approximately along the center of the neck 16, causes the green phosphor layer of phosphor screen 13 to emit light. Of the three electron beams, a pair of side beams, which are emitted on both sides of the center beam, cause the red phosphor layer and blue phosphor layer of phosphor screen 13 to emit light.

A deflection yoke 18 is mounted on the outside of the funnel 12 and generates non-uniform deflection magnetic fields for deflecting the three electron beams that are emitted from the electron gun assembly 17. The non-uniform deflection magnetic fields comprise a pincushion-shaped horizontal deflection magnetic field and a barrel-shaped vertical deflection magnetic field. The three electron beams are deflected by the non-uniform deflection magnetic fields, while being self-converged, and are scanned over the phosphor screen 13 in the horizontal direction and vertical direction. Thus, a color image is displayed on the phosphor screen 13.

The electron gun assembly 17 that is mounted in the cathode-ray tube includes three cathodes K (KB, KG, KR) and seven grids G1 to G7. The three cathodes K are horizontally arranged in line. Each cathode K accommodates a heater H. The three cathodes K are associated with blue, green and red.

The first grids G1 (G1B, G1G, G1R) are individually provided in association with the respective cathodes K. The three first grids G1 are disposed to face the cathodes K. A second grid G2 is disposed to face the phosphor screen side of the first grid G1. The second grid G2 is an electrode body with an integral structure. Third to seventh grids G3 to G7 are coaxially arranged in succession at predetermined intervals from the second grid G2 side toward the phosphor screen 13. A convergence cup C is fixed to the phosphor screen (13) side of the seventh grid G7.

In the electron gun assembly according to the first embodiment, each of the first grids G1 is formed of a cup-shaped electrode body having an electron beam passage hole. The bottom face of each cup-shaped electrode body has one electron beam passage hole. The second grid G2 is formed of a plate electrode body and has three electron beam passage holes. Each of the third to seventh grids G3 to G7 is formed of a plurality of cup-shaped electrode bodies that are combined. The bottom face of each cup-shaped electrode body has three electron beam passage holes. The cathodes K, heaters H and grids are integrally fixed by a pair of insulating support members 27 that are formed of glass.

A stem section 19 is provided at an end portion of the neck 16. The stem section 19 seals the envelope 10 in a vacuum state. A plurality of stem pins 20 penetrate the stem section 19 in the state in which the envelope 10 is kept airtight. The stem pins 20 are electrically connected to the respective electrodes of the electron gun assembly 17. The cathodes K and first to sixth grids G1 to G6 are supplied with predetermined voltages from outside via the stem pins 20.

An inside electrically conductive film 21 is provided on the inner surface of the envelope 10 over a range from an anode terminal provided on the funnel 12 to the neck 16. A bulb spacer 22 that is attached to the convergence cup C is put in pressure contact with, and electrically connected to, the inside conductive film 21. In other words, the convergence cup C is electrically and mechanically connected to the seventh grid G7. A high voltage is applied to the seventh grid G7 and convergence cup C from the anode terminal via the inside conductive film 21 and bulb spacer 22.

Figure 2:
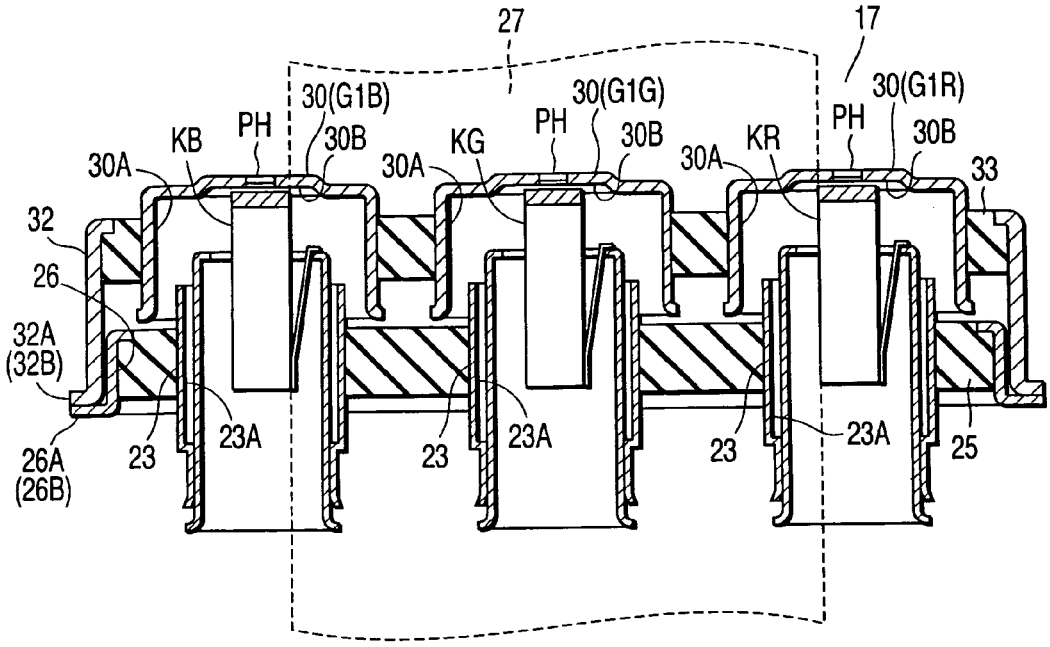
FIG. 2 is a horizontal cross-sectional view that schematically shows the structure of a part including cathodes and first grids of an electron gun assembly that is disposed in the cathode-ray tube shown in FIG. 1.

In the in-line electron gun assembly 17 with the above-described structure, the cathodes K, the first grids G1 that control electron beams emitted from the cathodes K, and the second grid G2 that accelerates the electron beams from the first grids G1 are configured as an electron beam generating section that generates electron beams toward the phosphor screen 13. In particular, the cathodes K and first grids G1 are constructed, as shown in FIG. 2.

Specifically, each of the three cathode support members 23 is formed in a cylindrical shape, extending in the tube-axis direction. Each cathode support member 23 holds, at its distal end side (i.e. first grid side), the associated cylindrical cathode K (KB, KG, KR) that incorporates the heater H. The three cathode support members 23 penetrate an insulation member 25 and are thus integrally held by the insulation member 25. The insulation member 25 is formed of, e.g. a glass material, and it surrounds the outer peripheries of side faces 23A of the cathode support members 23.

A cylindrical member 26 is configured to extend in the tube-axis direction and to surround the outer periphery of the insulation member 25. The cylindrical member 26 is formed of, e.g. a metal material. The cylindrical member 26 has an outwardly projecting edge portion 26A at the rear end side thereof (i.e. stem side). A part of the edge portion 26A functions as an implant part 26B and is implanted in the paired insulating support members 27.

Each first grid G1 (G1B, G1G, G1R) is formed of a cup-shaped electrode body 30 extending in the tube-axis direction. The cup-shaped electrode body 30 has one electron beam passage hole PH in its bottom face 30B. The three cup-shaped electrode bodies 30 penetrate an insulation member 33 and are thus integrally held by the insulation member 33. The insulation member 33 is formed of, e.g. a glass material, and surrounds the outer peripheries of side faces 30A of the cup-shaped electrodes 30.

A cylindrical member 32 is configured to extend in the tube-axis direction and to surround the outer periphery of the insulation member 33 at its distal end side (i.e. first grid side). The cylindrical member 26 is attached to the inside of the cylindrical member 32 at the rear end side (stem side) of the cylindrical member 32. The cylindrical member 32 is formed of, e.g. a metal material. The cylindrical member 32 has an outwardly projecting edge portion 32A at the rear end thereof. A part of the edge portion 32A functions as an implant part 32B and is implanted in the paired insulating support members 27.

The cathodes K (KB, KG, KR) and first grids G1 (G1B, G1G, G1R), which are integrated as described above, are coaxially arranged with predetermined distances and are fixed by the insulating support members 27. In this case, the first grids G1 (G1B, G1G, G1R) require no implant parts, which are conventionally needed to fix the first grids G1 to the insulating support members 27. The first grids G1 are independently held by the insulation member 33 and cylindrical member 32. Thus, the heat that is conducted from the cathodes K is substantially uniformly applied to the three first grids G1 (G1B, G1G, G1R), and thus these first grids G1 can quickly reach the thermally stable state.

The thermal deformation characteristics of the respective parts can be made uniform by equally setting, after the warming-up, the bias voltages to the center beam cathode KG, which is disposed substantially at the center of the neck, and to the side beam cathodes KB and KR, which are disposed on both sides of the center beam cathode KG. Therefore, immediately after power-on of the heater H that is sufficiently cooled, the distance between the three first grids G1 (G1B, G1G, G1R) and the associated cathodes K (KB, KG, KR) can be kept in substantially the same state.

Figure 3:
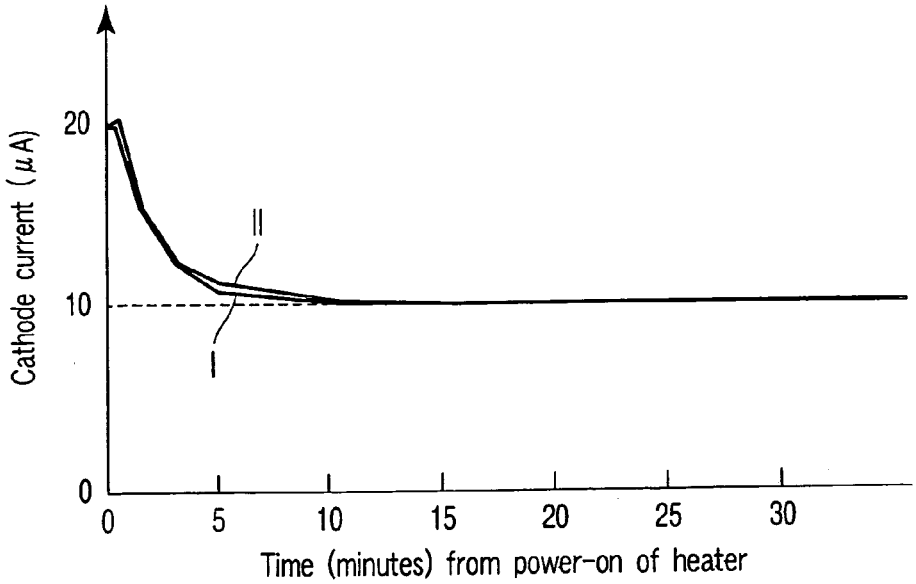
FIG. 3 is a graph showing cathode current characteristics of the cathode-ray tube according to the first embodiment.

FIG. 3 shows examples of IK value curves that are indicative of variations with time over a time period immediately after power-on until the IK value of each cathode reaches a predetermined constant value. In this case, the obtained IK value curves are based on the following setting. That is, the bias voltages are adjusted so that the cathode current values of the center beam cathode KG and the side beam cathode KR, KB may become 10 μA after the warming-up. Then, the heater is sufficiently cooled in the state in which only the heater voltage is turned off, following which the heater is powered on. FIG. 3 shows variations with time of the cathode current values after the power-on of the heater. In FIG. 3, curve I indicates the IK value characteristics of the center beam cathode KG of the three in-line cathodes K, and curve II indicates the IK value characteristics of the side beam cathode KG (KR).

As is shown in FIG. 3, the IK value characteristics of the side beam cathode KB (KR) can be made substantially similar to those of the center beam cathode KG. Specifically, the three first grids G1B, G1G and G1R do not require implant parts that have different shapes. The three first grids G1B, G1G and G1R are formed of cup-shaped electrode bodies 30 having the same shape and are supported by the insulating support members 27 via the implant part 32B of the cylindrical member 32 in the state in which all the cup-shaped electrode bodies 30 are integrally held by the insulation member 33 and cylindrical member 32.

By virtue of the above features, the temperatures and thermal expansion of the electrode components of the first grids G1 substantially equally affect the center beam first grid G1G and the side beam first grids G1B and G1R. Therefore, the respective parts reach the thermal equilibrium state from a time immediately after power-on. In short, the time period, which is needed until the IK values of the respective cathodes become equal, can remarkably be decreased. Hence, the distance between the center beam cathode KG and first grid G1G, the distance between the side beam cathode KR and first grid G1R and the distance between the side beam cathode KB and first grid G1B will vary with time in the state in which these distances are kept substantially equal from the time immediately after power-on.

Therefore, in the electron gun assembly with the above-described structure, each of the IK values can quickly be set at the predetermined fixed value from the time immediately after power-on. In addition, as regards the color cathode-ray tube that incorporates this electron gun assembly, when the color cathode-ray tube is assembled in the cathode-ray tube apparatus and powered on, a high-quality image (esp. white image) can be obtained at substantially the same time as image display begins. The time period in which a low-quality image is displayed can greatly be reduced.

In the above-described first embodiment of the invention, the method of supporting the cathodes K is not limited, and it should suffice if the three cup-shaped electrode bodies each having the electron beam passage hole are integrally fixed by the insulation member and cylindrical member. For example, the three cathodes K may be fixed by means of implant members, etc. to the insulation glass that integrally fixes the grids.

A second embodiment of the invention will now be described. The parts in the second embodiment, which are common to those in the first embodiment, are denoted by like reference numerals, and a detailed description is omitted.

Figure 4:
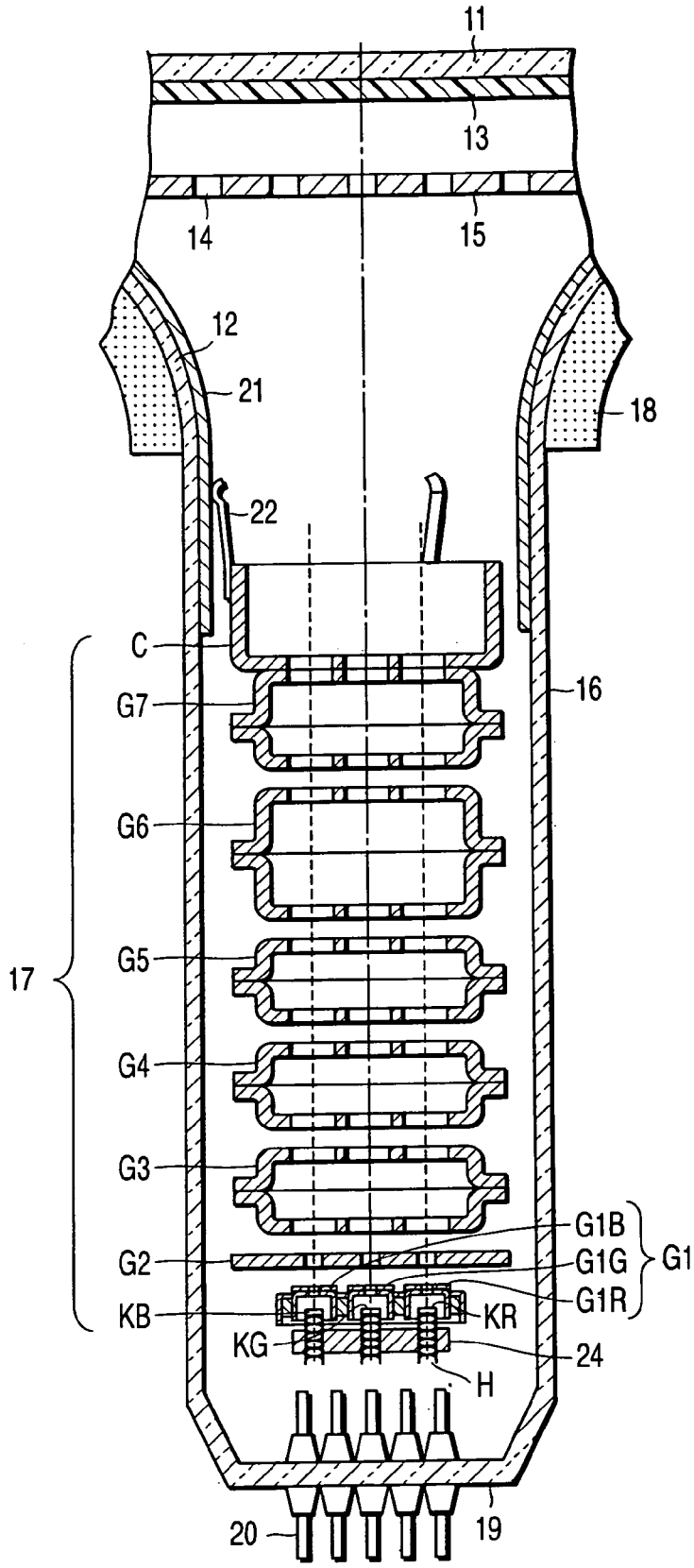
FIG. 4 is a horizontal cross-sectional view that schematically shows the structure of a cathode-ray tube according to a second embodiment of the present invention.
Figure 5:
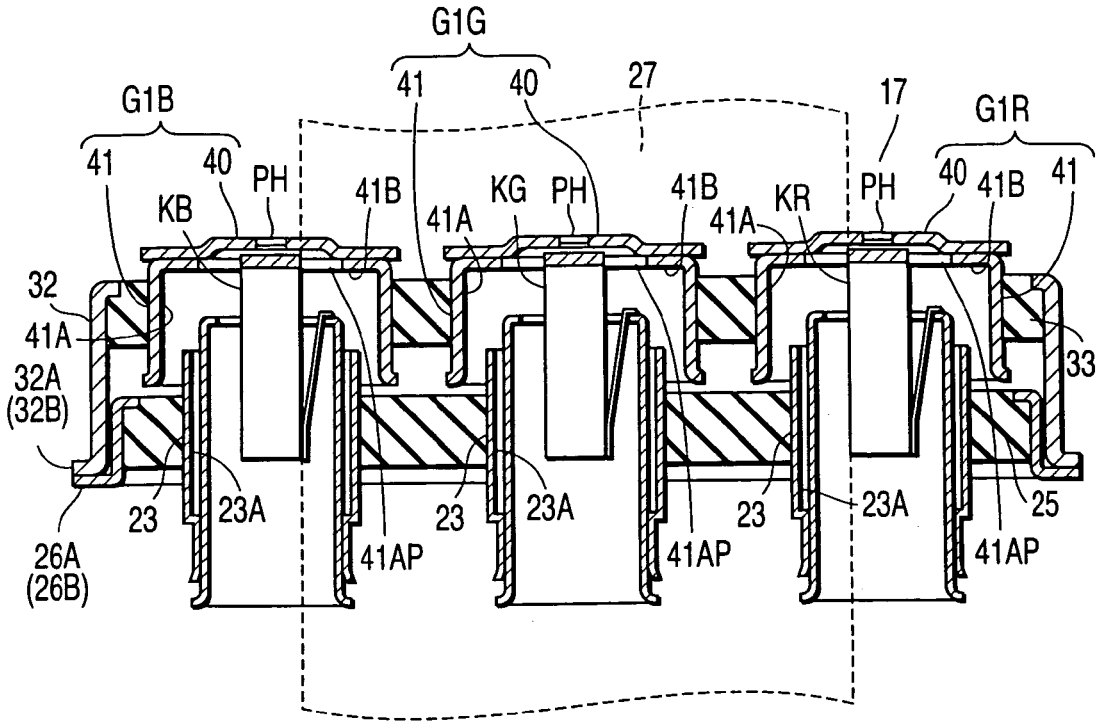
FIG. 5 is a horizontal cross-sectional view that schematically shows the structure of a part including cathodes and first grids of an electron gun assembly that is disposed in the cathode-ray tube shown in FIG. 4.

In an electron gun assembly according to the second embodiment, as shown in FIG. 4 and FIG. 5, each of first grids G1 comprises a first grid disc 40 with an electron beam passage hole, and a cup-shaped first grid support member 41 to which the first grid disc 40 is fixed. The second to seventh grids G2 to G7 and convergence cup C are constructed similarly with the first embodiment. The three cathodes K, heaters H and grids are integrally fixed by a pair of insulating support members 27 that are formed of glass.

In the in-line electron gun assembly 17 with the above-described structure, the cathodes K, the first grids G1 that control electron beams emitted from the cathodes K, and the second grid G2 that accelerates the electron beams from the first grids G1 are configured as an electron beam generating section that generates electron beams toward the phosphor screen 13. In particular, the cathodes K and first grids G1 are constructed, as shown in FIG. 5.

Specifically, each of the three cathode support members 23 is formed in a cylindrical shape, extending in the tube-axis direction. Each cathode support member 23 holds, at its distal end side (i.e. first grid side), the associated cylindrical cathode K (KB, KG, KR) that incorporates the heater H. The three cathode support members 23 penetrate an insulation member 25 and are thus integrally held by the insulation member 25. The insulation member 25 is formed of, e.g. a glass material, and it surrounds the outer peripheries of side faces 23A of the cathode support members 23.

A cylindrical member 26 is configured to extend in the tube-axis direction and to surround the outer periphery of the insulation member 25. The cylindrical member 26 is formed of, e.g. a metal material. The cylindrical member 26 has an outwardly projecting edge portion 26A at the rear end side thereof (i.e. stem side). A part of the edge portion 26A functions as an implant part 26B and is implanted in the paired insulating support members 27.

The first grid G1 (G1B, G1G, G1R) comprises the first grid disc 40 with a flat circular shape, and the cup-shaped first grid support member 41 extending in the tube-axis direction. The first grid disc 40 and first grid support member 41 of the first grid G1 are formed of metal materials having substantially equal thermal expansion coefficients, and are preferably formed of the same metal material. The first grid support member 41 has a bottom portion 41B that is provided with a substantially circular opening 41AP. The opening 41AP has a greater diameter than the cathode K. The first grid disc 40 is formed in a flat circular shape, which is larger in size than the opening 41AP in the first grid support member 41. The first grid disc 40 is fixed by welding to the bottom portion 41B so as to cover the opening 41AP. Each first grid disc 40 has one electron beam passage hole PH at a substantially central part thereof.

The three first grid support members 41 penetrate an insulation member 33 and are thus integrally held by the insulation member 33. The insulation member 33 is formed of, e.g. a glass material, and surrounds the outer peripheries of side faces 41A of the first grid support members 41.

A cylindrical member 32 is configured to extend in the tube-axis direction and to surround the outer periphery of the insulation member 33 at its distal end side (i.e. first grid side). The cylindrical member 26 is attached to the inside of the cylindrical member 32 at the rear end side (stem side) of the cylindrical member 32. The cylindrical member 32 is formed of, e.g. a metal material. The cylindrical member 32 has an edge portion 32A that is formed of, e.g. a metal material and projects outward at the rear end of the cylindrical member 32. A part of the edge portion 32A functions as an implant part 32B and is implanted in the paired insulating support members 27.

The first grids G1 are constructed as follows. The first grid support members 41 are made to penetrate the insulation member 33. The insulation member 33 is then integrally provided at the distal end portion of the cylindrical member 32. Subsequently, the first grid disc 40 is fixed by welding to the bottom portion 41B of the associated first grid support member 41.

The integrated cathodes K (KB, KG, KR) and first grids G1 (G1B, G1G, G1R) are coaxially arranged with predetermined distances and are fixed by the insulating support members 27. In this case, the first grids G1 (G1B, G1G, G1R) require no implant parts, which are conventionally needed to fix the first grids G1 to the insulating support members 27. The first grids G1 are independently held by the insulation member 33 and cylindrical member 32. Thus, the heat that is conducted from the cathodes K is substantially uniformly applied to the three first grids G1 (G1B, G1G, G1R), and thus these first grids G1 can quickly reach the thermally stable state.

The thermal deformation characteristics of the respective parts can be made uniform by equally setting, after the warming-up, the bias voltages to the center beam cathode KG, which is disposed substantially at the center of the neck, and to the side beam cathodes KB and KR, which are disposed on both sides of the center beam cathode KG. Therefore, immediately after power-on of the heater H that is sufficiently cooled, the distances between the three first grids G1 (G1B, G1G, G1R) and the associated cathodes K (KB, KG, KR) can be kept in substantially the same state.

Figure 6:
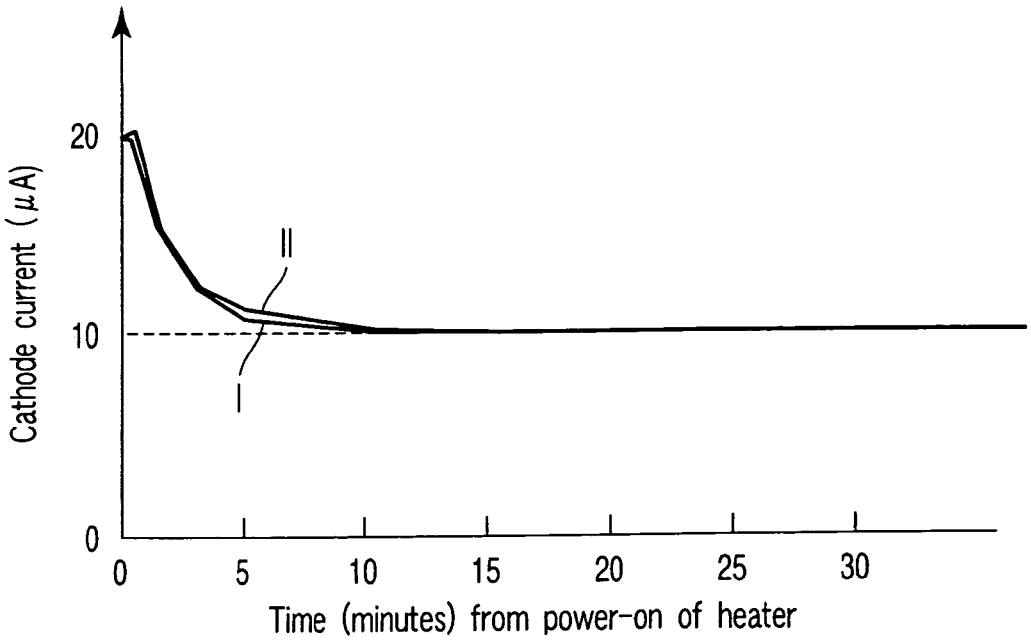
FIG. 6 is a graph showing cathode current characteristics of the cathode-ray tube according to the second embodiment.
Figure 7:
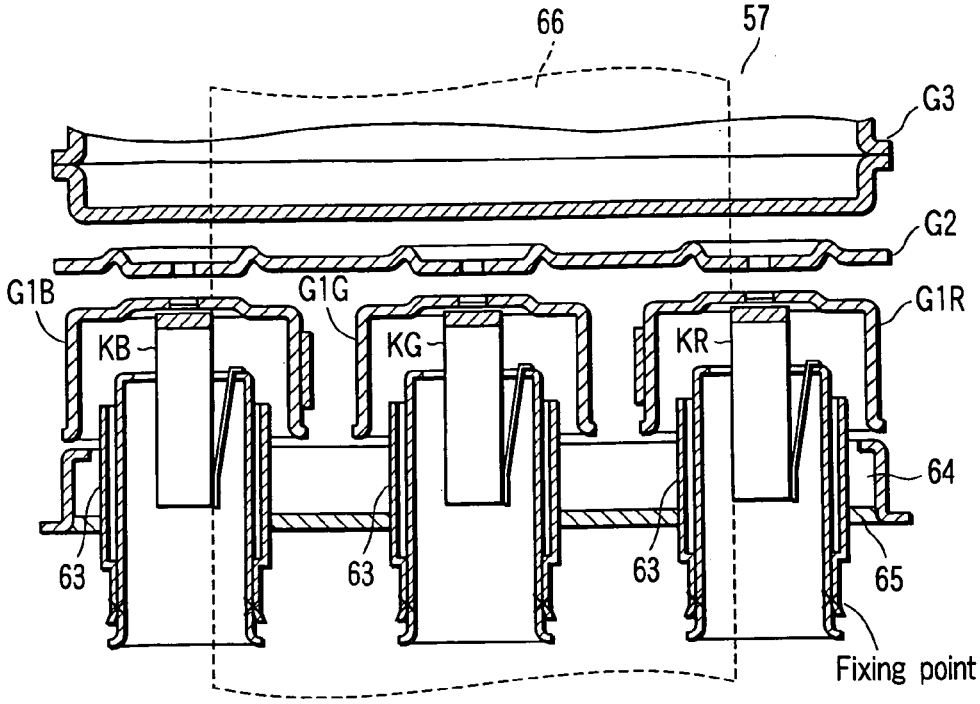
FIG. 7 PRIOR ART
FIG. 7 is a horizontal cross-sectional view that schematically shows the structure of an electron beam generating section in a prior-art cathode-ray tube.
Figure 8:
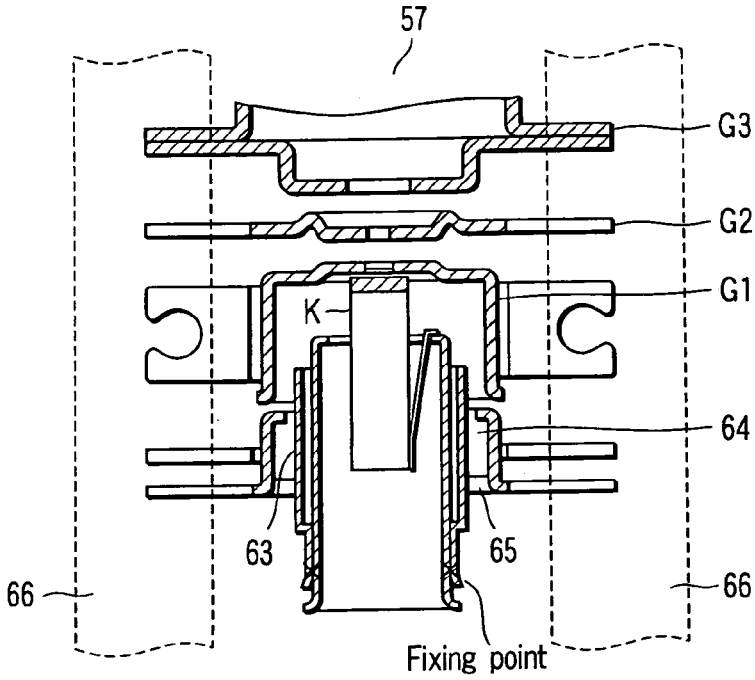
FIG. 8 PRIOR ART
FIG. 8 is a vertical cross-sectional view that schematically shows the structure of the prior-art electron beam generating section shown in FIG. 7.
Figure 9:
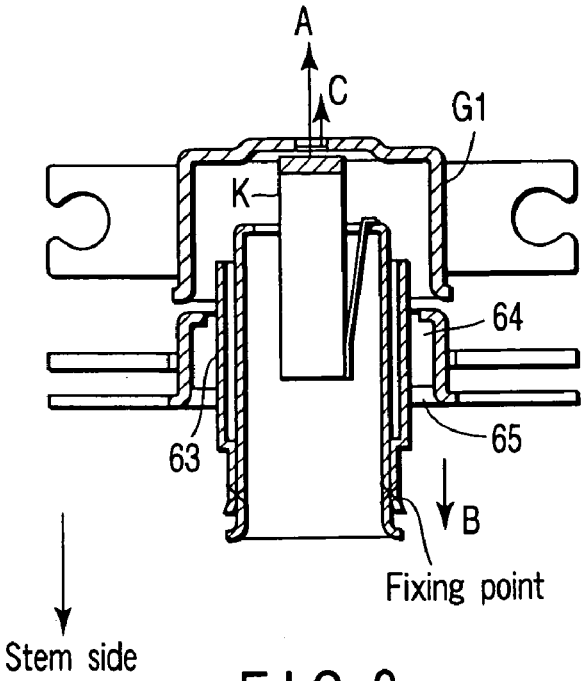
FIG. 9 PRIOR ART
FIG. 9 is a cross-sectional view for explaining directions of extension of electrode components due to thermal expansion, which constitute the electron beam generating section shown in FIG. 8.
Figure 10:
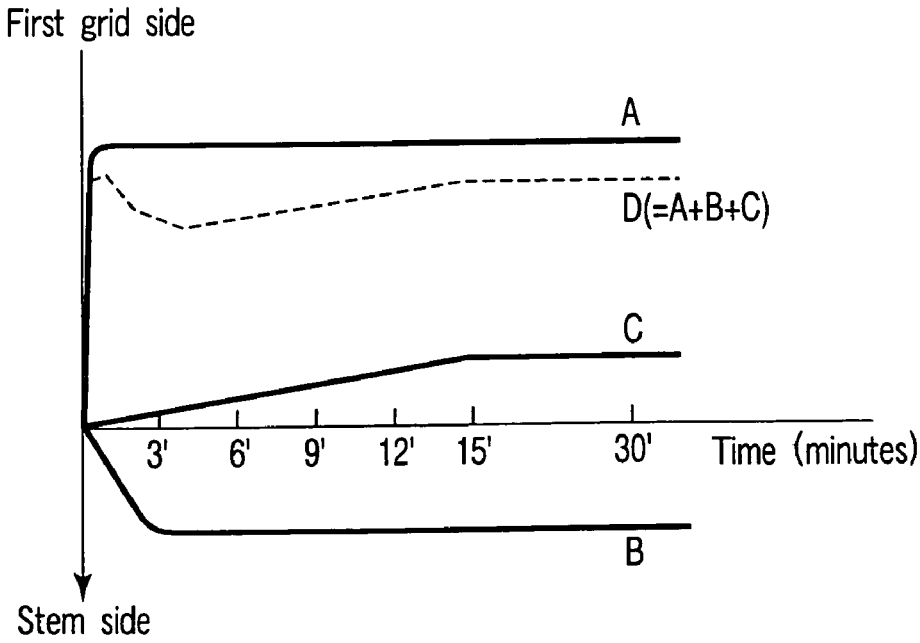
FIG. 10 PRIOR ART
FIG. 10 is a graph showing characteristic curves that are indicative of variations with time in extension of the respective parts shown in FIG. 9.
Figure 11:
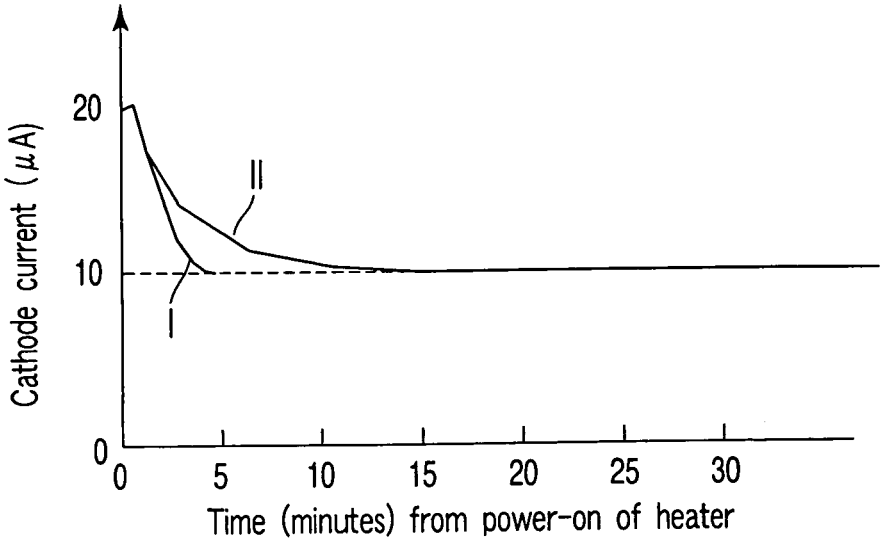
FIG. 11 PRIOR ART
FIG. 11 is a graph showing cathode current characteristics of the prior-art cathode-ray tube.
Figure 12:
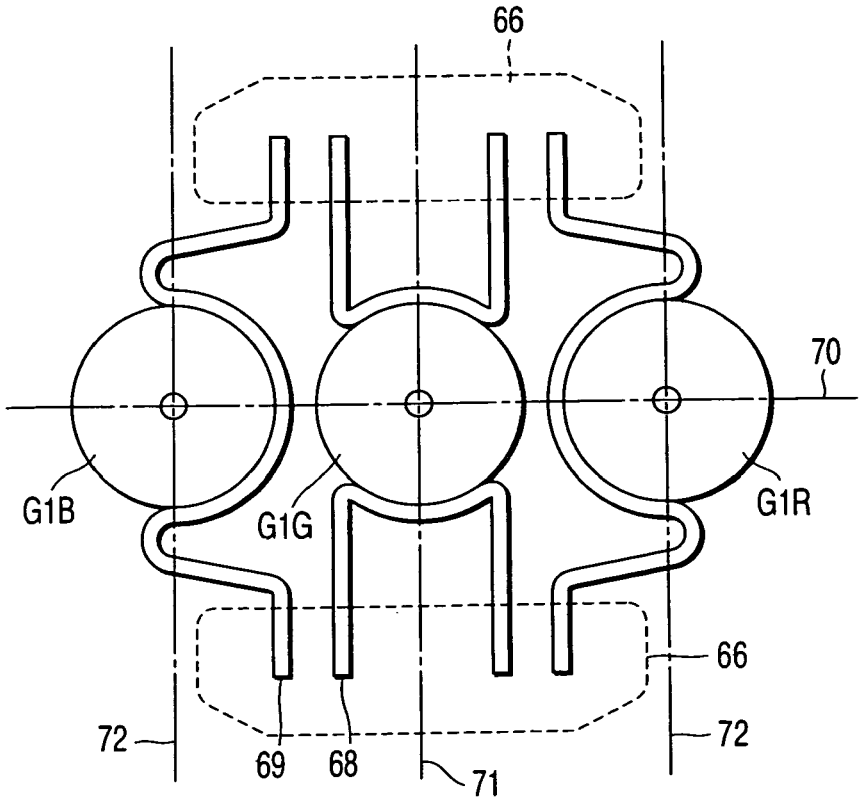
FIG. 12 PRIOR ART
FIG. 12 is a front view of the first grid section, as viewed from the phosphor screen side at right angles with the tube axis.

FIG. 6 shows examples of IK value curves that are indicative of variations with time over a time period immediately after power-on until the IK value of each cathode takes a predetermined constant value. In this case, the IK value curves are based on the following setting. That is, the bias voltages are adjusted so that the cathode current values of the center beam cathode KG and the side beam cathode KR, KB may become 10 μA after the warming-up. Then, the heater is sufficiently cooled in the state in which only the heater voltage is turned off, following which the heater is powered on. FIG. 6 shows variations with time of the cathode current values after the power-on of the heater. In FIG. 6, curve I indicates the IK value characteristics of the center beam cathode KG of the three in-line cathodes K, and curve II indicates the IK value characteristics of the side beam cathode KG (KR).

As is shown in FIG. 6, the IK value characteristics of the side beam cathode KB (KR) can be made substantially similar to those of the center beam cathode KG. Specifically, the three first grids G1B, G1G and G1R do not require implant parts that have different shapes. The three first grids G1B, G1G and G1R are formed of combinations of the first grid discs 40 and first grid support members 41, which have the same shapes. Moreover, the three first grids G1B, G1G and G1R are supported by the insulating support members 27 via the implant part 32B of the cylindrical member 32 in the state in which all the first grid support members 41 are integrally held by the insulation member 33 and cylindrical member 32.

By virtue of the above features, the temperatures and thermal expansion of the electrode components of the first grids G1 substantially equally affect the center beam first grid G1G and the side beam first grids G1B and G1R. Therefore, the respective parts reach the thermal equilibrium state from a time immediately after power-on. In short, the time period, which is needed until the IK values of the respective cathodes become equal, can remarkably be decreased. Hence, the distance between the center beam cathode KG and first grid G1G, the distance between the side beam cathode KR and first grid G1R and the distance between the side beam cathode KB and first grid G1B will vary with time in the state in which these distances are kept substantially equal from the time immediately after power-on.

In the second embodiment, each first grid G1 comprises the first grid support member 41 and first grid disc 40, which are formed of metal materials with substantially equal thermal expansion coefficients. Thus, even if the first grid G1 is composed of a plurality of components, the same function as the cup-shaped electrode body 30 comprising a single component, which has been described in connection with the first embodiment, can be realized. Thermal deformation, etc. can greatly be reduced between the first grid disc 40 and first grid support member 41.

Furthermore, in the second embodiment, the first grids G1 are constructed as follows. The three first grid support members 41 are made to penetrate the insulation member 33. The cylindrical member 32 is then fixed so as to surround the insulation member 33. Thereafter, the three first grid discs 40 are fixed by welding to the associated three first grid support members 41. It is easy, therefore, to correct non-uniformity in attachment precision, such as the pitch, flatness and linearity of the three first grid support members 41, which will occur when the first grids G1 are fixed. The precision in assembly of the three first grid discs 40 can be enhanced.

Hence, in the electron gun assembly with the above-described structure, each of the IK values can quickly be set at the predetermined fixed value from the time immediately after power-on. In addition, as regards the color cathode-ray tube that incorporates this electron gun assembly, when the color cathode-ray tube is assembled in the cathode-ray tube apparatus and powered on, a high-quality image (esp. white image) can be obtained at substantially the same time as image display begins. The time period in which a low-quality image is displayed can greatly be reduced.

In the above-described second embodiment of the invention, the method of supporting the cathodes K is not limited, like the first embodiment, and it should suffice if the three first grid support members are integrally fixed by the insulation member and cylindrical member. Besides, the structure and shape of each grid of the electron gun assembly can be modified, apart from the above-described first and second embodiments. Needless to say, other various applications and modifications can be made.

As has been described above, according to the cathode-ray tubes of the embodiments, since the IK value characteristics of the cathodes for the center beam and side beams can be made similar, each of the IK values can quickly be set at the predetermined fixed value after bias voltages are adjusted. Thus, the time period, which is needed until a high-quality white image is obtained after power-on of the color cathode-ray tube, can greatly be reduced. Accordingly, the time period in which a low-quality image is reproduced can be shortened, and a high-quality reproduction image can quickly be obtained. Besides, there is no need to perform readjustment by opening the color cathode-ray tube apparatus, and the productivity of the color cathode-ray tube and the color cathode-ray tube apparatus incorporating the color cathode-ray tube can be enhanced.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode-ray tube comprising an electron gun assembly that emits three electron beams, which are arranged in line, toward a phosphor screen, wherein the electron gun assembly comprises three cathodes arranged in line, three first grids arranged to face the associated cathodes, and a second grid with an integral structure that is disposed to face a phosphor screen side of the first grids, each of the first grids is a cup-shaped electrode body having an electron beam passage hole, and the electron gun assembly comprises:

an insulation member through which the three first grids penetrate, the insulation member thus integrally holding the three first grids;

a cylindrical member that surrounds the insulation member and has an implant part; and an insulating support member that supports the implant part of the cylindrical member.

2. A cathode-ray tube comprising an electron gun assembly that emits three electron beams, which are arranged in line, toward a phosphor screen, wherein the electron gun assembly comprises three cathodes arranged in line, three first grids arranged to face the associated cathodes, and a second grid with an integral structure that is disposed to face a phosphor screen side of the first grids, each of the first grids comprises a grid disc having an electron beam passage hole, and a cup-shaped grid support member that supports the grid disc, and the electron gun assembly comprises:

an insulation member through which the three grid support members penetrate, the insulation member thus integrally holding the three grid support members;

a cylindrical member that surrounds the insulation member and has an implant part; and an insulating support member that supports the implant part of the cylindrical member.

3. The cathode-ray tube according to claim 2, wherein the grid support member and the grid disc are formed of metal materials that have substantially equal thermal expansion coefficients.

4. The cathode-ray tube according to claim 2, wherein the grid disc is fixed by welding to a bottom part of the grid support member.

* * * * *